US005862538A

United States Patent [19]

Ho

[11] Patent Number: 5,862,538

[45] Date of Patent: Jan. 26, 1999

[54] TOILET FLUSHING DEVICE

[76] Inventor: Chung-Yi Ho, 2f, No. 1-1, Alley 49, Lane.101, Ching-Shan Rd., Shih-Lin Dist., Taipei City, Taiwan

[21] Appl. No.: 975,184

[22] Filed: Nov. 20, 1997

[51] Int. Cl.[6] ..... E03D 1/36

[52] U.S. Cl. ..... 004/366; 4/331; 137/441; 137/625.048; 137/881

[58] Field of Search ..... 4/366, 367, 329, 4/332; 137/881, 625.48, 441, 423

[56] References Cited

U.S. PATENT DOCUMENTS

| | | | |
|---|---|---|---|
| 3,086,217 | 4/1963 | Barlow | 4/367 |
| 4,318,194 | 3/1982 | Pinkston | 4/366 |
| 4,420,845 | 12/1983 | Antunez | 4/366 |
| 4,996,726 | 3/1991 | Schrock et al. | 4/366 X |
| 5,175,894 | 1/1993 | Chen | 4/331 |

*Primary Examiner*—Henry J. Recla
*Assistant Examiner*—Kathleen J. Prunner
*Attorney, Agent, or Firm*—Baker & Botts, L.L.P.

[57] ABSTRACT

A toilet flushing device is to be installed in a water supply tank and has a diverter valve which permits the supply of high pressure water to the rim flushing conduit of a toilet bowl when the toilet bowl is flushed. The diverter valve has a valve housing and a valve rod disposed movably in the valve housing in response to increase or decrease of the water level. A passage is formed longitudinally through the valve rod so as to direct high pressure water to the water supply tank, thereby preventing fouling formation in the passage of the valve rod.

5 Claims, 10 Drawing Sheets

TOILET FLUSHING DEVICE

BACKGROUND OF THE INVENTION

1. Field of the Invention

This invention relates to a toilet flushing device, more particularly to a toilet flushing which has a diverter valve unit for directing water from the water supplying pipe to the rim flushing conduit of a toilet bowl.

2. Description of the Related Art

U.S. Pat. No. 5,175,894 discloses a toilet flushing device which has a diverter valve that permits the supply of high pressure water to the rim flushing conduit of a toilet bowl when the toilet bowl is flushed. The diverter valve has a flap rotatably provided inside a hollow valve housing for controlling water flow from the water supplying pipe. However, the rotation of the flap is often prevented by the water fouling that forms on the rotation axle of the flap, thereby resulting in malfunction of the toilet flushing device.

SUMMARY OF THE INVENTION

The object of the present invention is to provide a toilet flushing device which can overcome the problem that is in associated with the aforementioned toilet flushing device of the prior art.

Accordingly, the preferred embodiment of a toilet flushing device of the present invention is to be installed in a toilet bowl assembly with a water supply tank and a toilet bowl having a rim-flushing conduit and a neck portion. The toilet flushing device includes a water supplying pipe extending into the water supply tank and having a lower end connected to an external pressurized water source; float-controlled valve means provided on an upper end of the water supplying pipe to control water to flow from the water supplying pipe to the water supply tank; manually operated flush valve means for discharging water inside the water supply tank to the neck portion of the toilet bowl; and diverter valve means for communicating fluidly the water supplying pipe and the water supply tank. The diverter valve means includes a hollow valve housing, a transverse inlet pipe which receives water from the water supplying pipe, and a transverse supply line connected to and supplying water to the rim flushing conduit of the toilet bowl.

The valve housing has top and bottom walls, a transverse partition wall between the top and bottom walls, and upper and lower chambers divided by the partition wall. The partition wall has an opening and a first valve seat confining the opening. The inlet pipe and the supply line are communicated respectively with the upper and lower chambers. The valve housing further has communication means for interconnecting the upper chamber and the water supply tank.

The diverter valve means further has a valve rod with upper and lower ends. The upper end of the valve rod extends into the upper chamber and is provided with a valve member. The lower end extends out of the valve housing. The valve rod passes through the opening of the partition wall without sealing the opening and extends sealingly through the bottom wall. The valve rod is normally biased upward so as to move the valve member away from the first valve seat, thereby permitting water from the inlet pipe to flow from the upper chamber to the lower chamber by passing through the opening around the valve rod and then to the supply line.

The diverter valve means further has a float member which is connected movably to the valve rod and which is movable downward, in response to a decrease in the water level inside the water supply tank when the flush valve means is operated, to pull down the valve rod, thereby moving the valve member downward to the first valve seat and interrupting communication between the upper and lower chambers and permitting water from the inlet pipe to flow through the communicating means to refill the water supply tank.

The high pressure water from the inlet pipe can wash the communicating means when flowing through the same, thereby preventing fouling formation in the communication means.

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
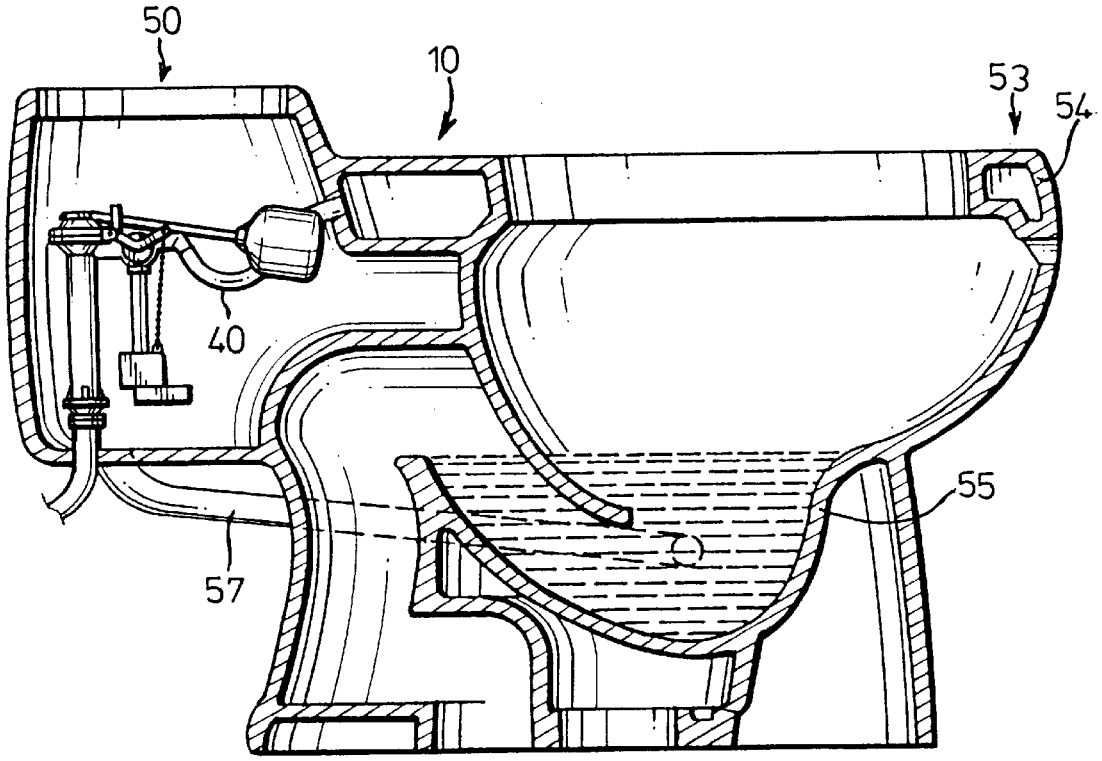
FIG. 1 illustrates the preferred embodiment of a toilet flushing device according to the present invention when installed in a toilet bowl assembly.
Figure 2:
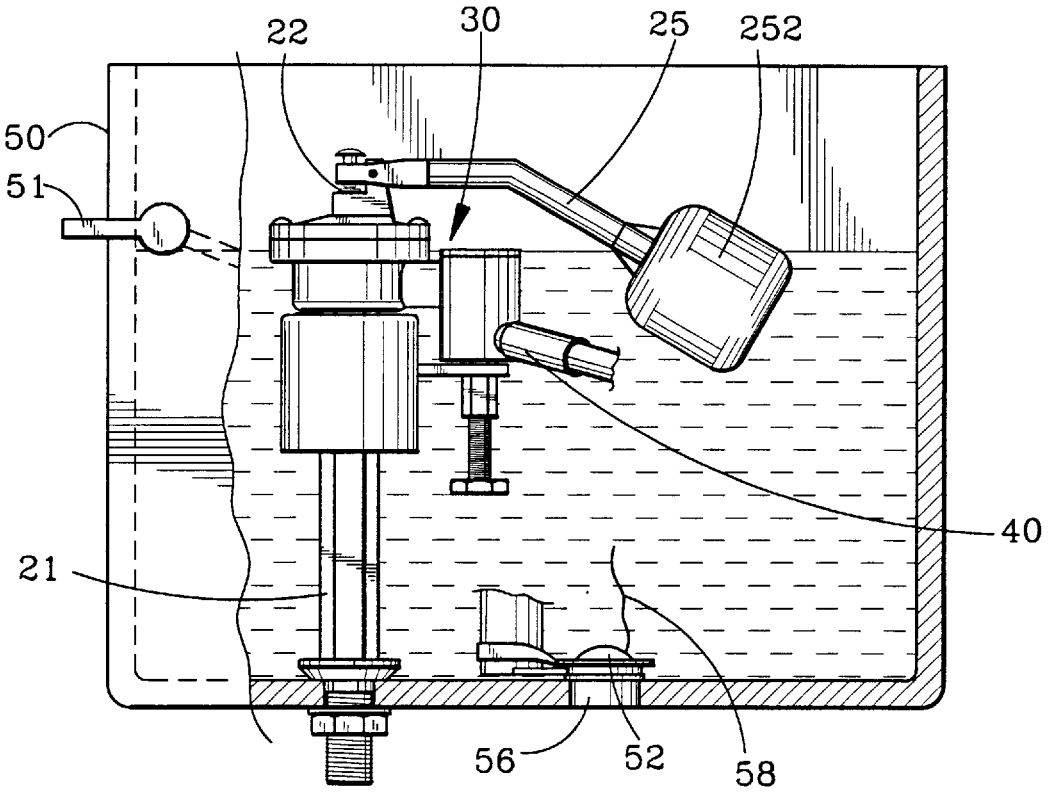
FIG. 2 is a partly sectional view of the toilet flushing device of the present invention when in a normal state.

Referring to FIGS. 1 and 2, the preferred embodiment of a toilet flushing device according to the present invention is shown to be installed in a toilet bowl assembly 10. The toilet bowl assembly 10 includes a water supply tank 50 and a toilet bowl 53 having a rim flushing conduit 54 and a neck portion 55. A water supplying pipe 21 extends into the water supply tank 50 and has a lower end connected to an external pressurized water source and an upper end provided with a conventional ball-cock valve 22. A rod 25 connects the ball-cock valve 22 to a main float 252. The water supply tank 50 is provided with a discharge outlet 56. A flapper valve 52 normally closes the discharge outlet 56, and has one end hinged to the water supply tank 50. The other end of the flapper valve 52 is tied to an actuating arm of a conventional flush arm 51, which is mounted on the exterior of the tank 50 by means of a chain or cable 58. The flush handle 51 is operated so as to lift the flapper valve 52 to allow water in the tank 50 to flow through the discharge outlet 56. A discharge pipe 57 directs water flowing through the discharge outlet 56 to the neck portion 55 of the toilet bowl 53 in a conventional manner. As the water level in the tank 50 drops, the main float 252 will be lowered, thereby opening the ball-cock valve 22. Water from the water supplying pipe 21 is directed to diverter valve means 30 of the toilet flushing device, which communicates fluidly the water supplying pipe 21 and the water supply tank 50, so as to refill the tank 50 until the normal water level is reached, whereupon the main float 252 closes the ball-cock valve 22.

Referring to FIGS. 1, 3, 4, 5 and 6, the diverter valve means 30 of the present invention includes a hollow valve housing 31, a transverse inlet pipe (21*b*) which receives water from the water supplying pipe 21, and a transverse supply line 40 connected to and supplying water to the rim flushing rim conduit 54.

The valve housing 31 is substantially cylindrical in shape and has top and bottom walls 3101, 3102, a transverse partition wall 3103 between the top and bottom walls 3101, 3102, and upper and lower chambers (31*a*, 31*b*) divided by the partition wall 3103. The partition wall 3103 has an opening 311 and a first valve seat 3111 confining the opening 311. The inlet pipe (21*b*)and the supply line 40 are communicated respectively with the upper and lower chambers (31*a*, 31*b*). The valve housing 31 further has communication means for interconnecting the upper chamber (31*a*) and the water supply tank 50, which will be described below.

Figure 3:
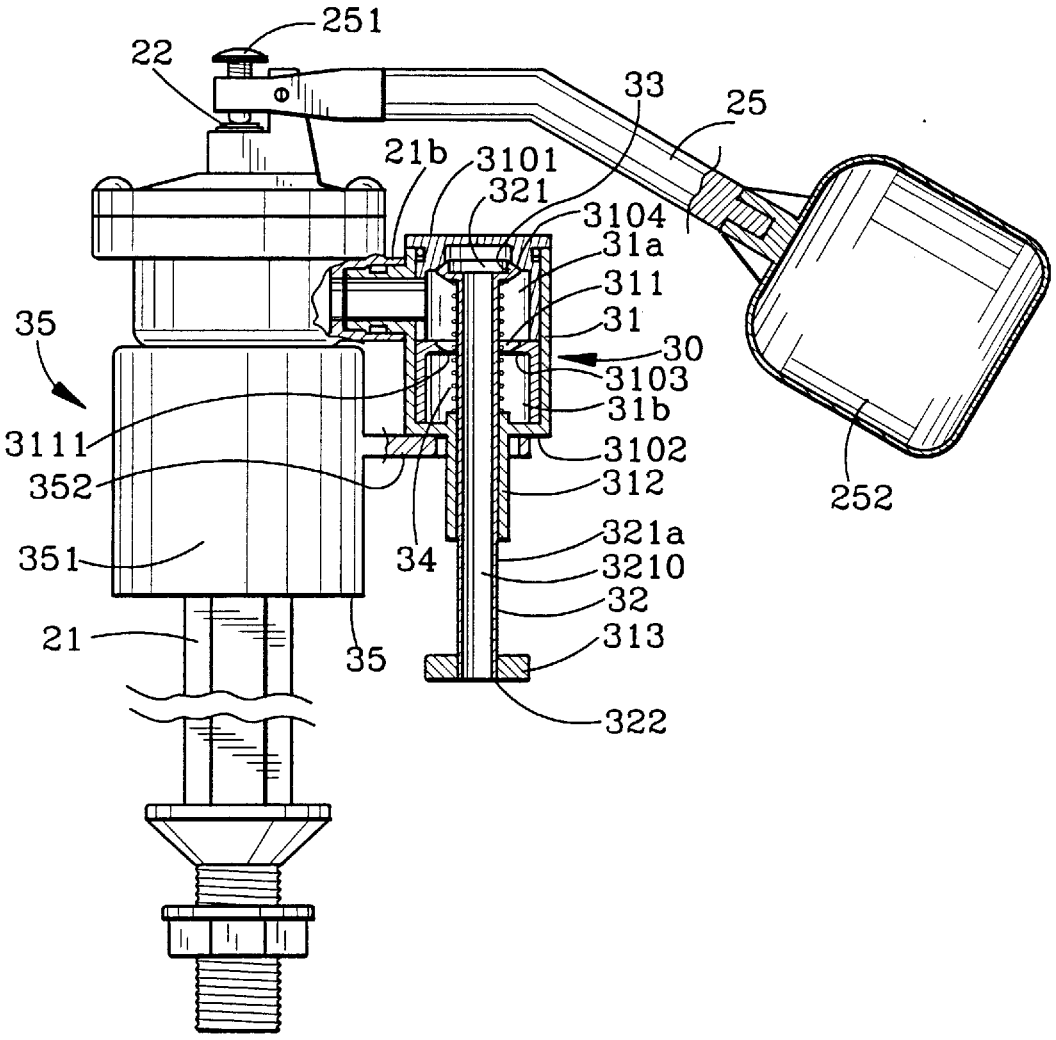
FIG. 3 is a partly sectional view of the diverter valve means of the toilet flushing device of the present invention when the latter is in the normal state.
Figure 5:
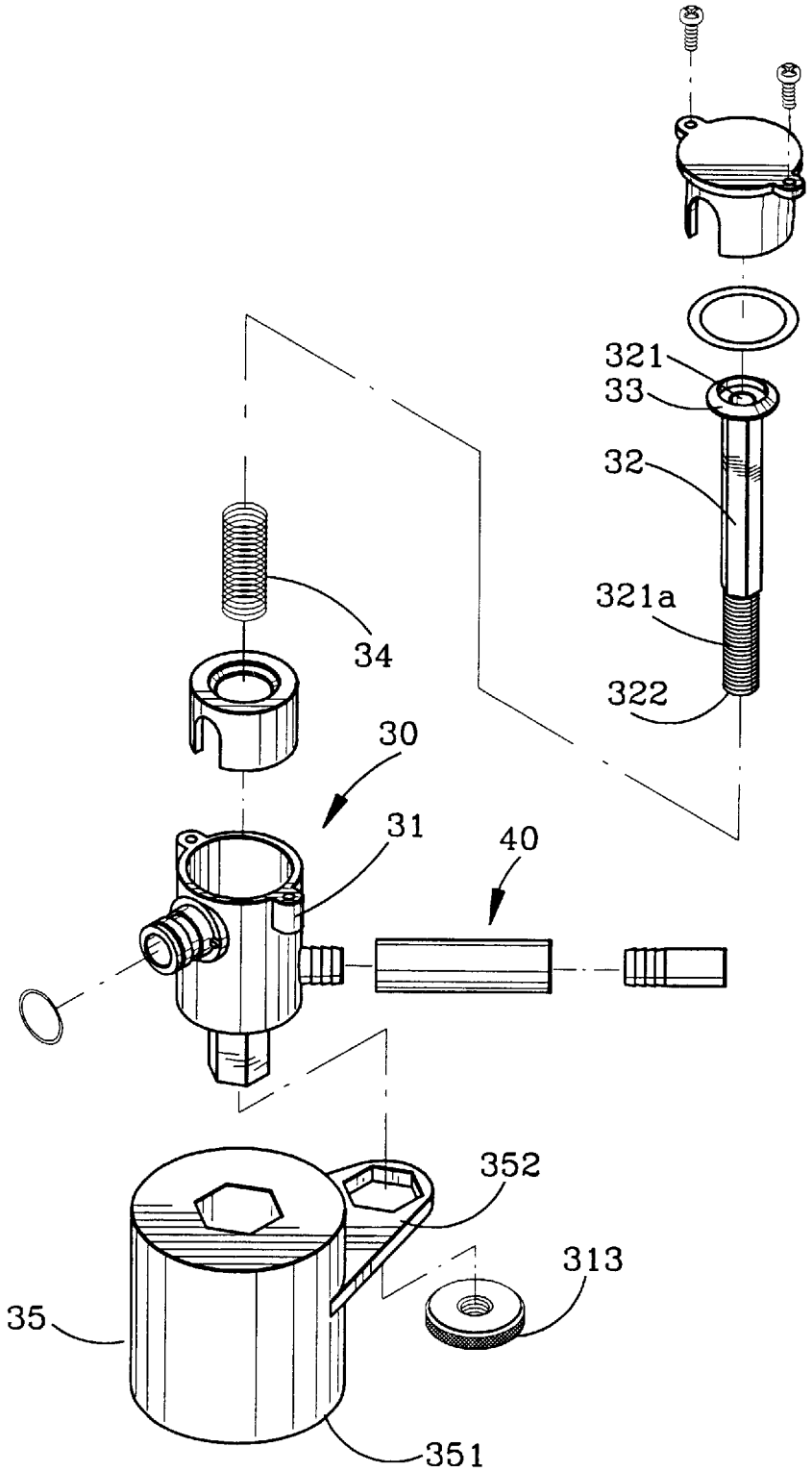
FIG. 5 is an exploded view of the diverter valve means of the toilet flushing device according to the present invention.
Figure 6:
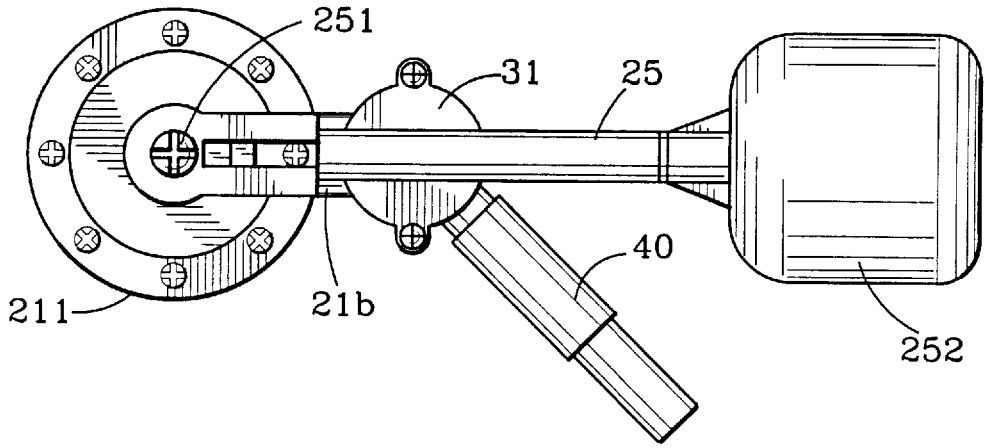
FIG. 6 is a top view of the toilet flushing device in FIG. 3.

Referring to FIGS. 3 and 5, the diverter valve means 30 further has a valve rod 32 with upper and lower ends 321, 322, and a passage 3210 which extends longitudinally through the valve rod 32 and which serves as the communicating means. Alternatively, the communicating means may be a hole formed in the top wall of the valve housing 31 when the valve rod 32 is formed as a solid rod. The upper end 321 of the valve rod 32 extends into the upper chamber (31*a*) and is provided with a valve member 33. The lower end 322 extends out of a bottom extension tube 312 of the valve housing 31. The valve rod 32 passes through the opening 311 of the partition wall 3103 without sealing the opening 311 and extends sealingly through the extension tube 312 on the bottom wall 3102. A threaded portion (321*a*) is provided adjacent to the lower end 322 of the valve rod 32. A nut 313 engages the threaded portion (321*a*). The top wall 3101 of the valve housing 31 has a second valve seat 3104 formed therein. The valve rod 32 has a spring member 34 sleeved therearound between the valve member 33 and the bottom wall 3102. The spring member 34 biases normally the valve rod 32 upward so as to move the valve member 33 away from the first valve seat 3111 and to seat the valve member 33 against the second valve seat 3104.

Figure 4:
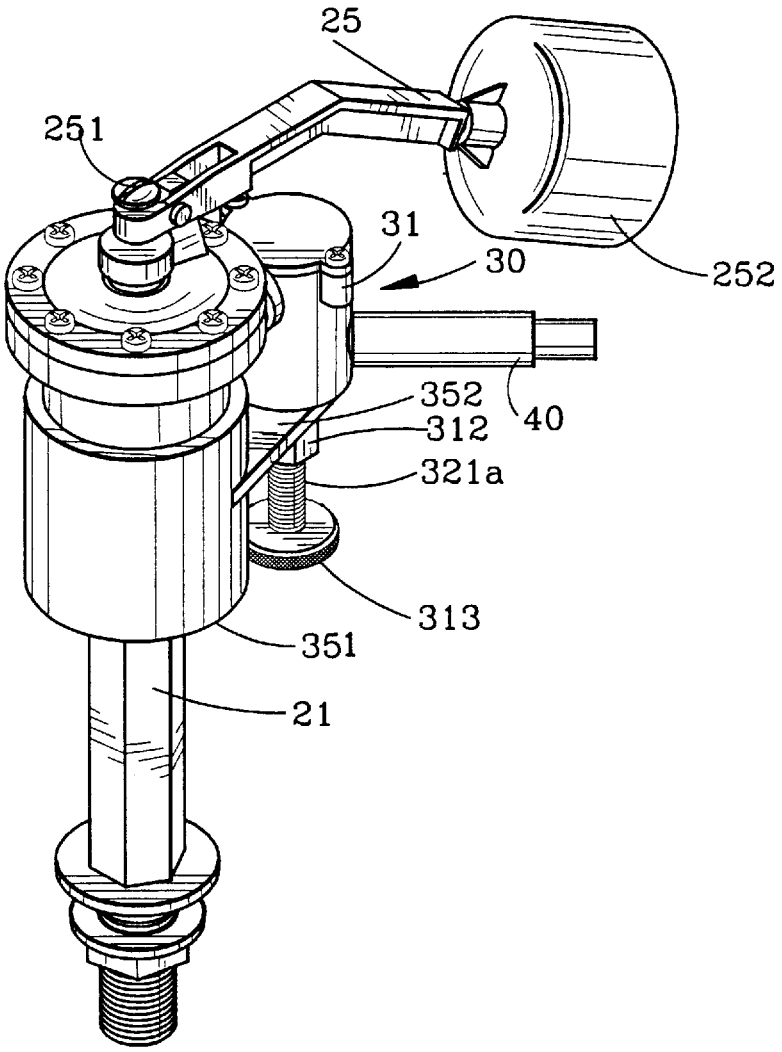
FIG. 4 is a perspective view of the toilet flushing device of the present invention when in the normal state.

Referring to FIGS. 3, 4 and 5, the diverter valve means 30 further has a float member 35 having a float body 351 sleeved on the water supplying pipe 21, and a transverse plate 352 which extends from the float body 351. The extension tube 312 and the valve rod 32 extend slidably through the transverse plate 352. However, the float member 35 may be sleeved directly on the extension tube 312 and the valve rod 32 without using the aforementioned extension plate 352.

Figure 7:
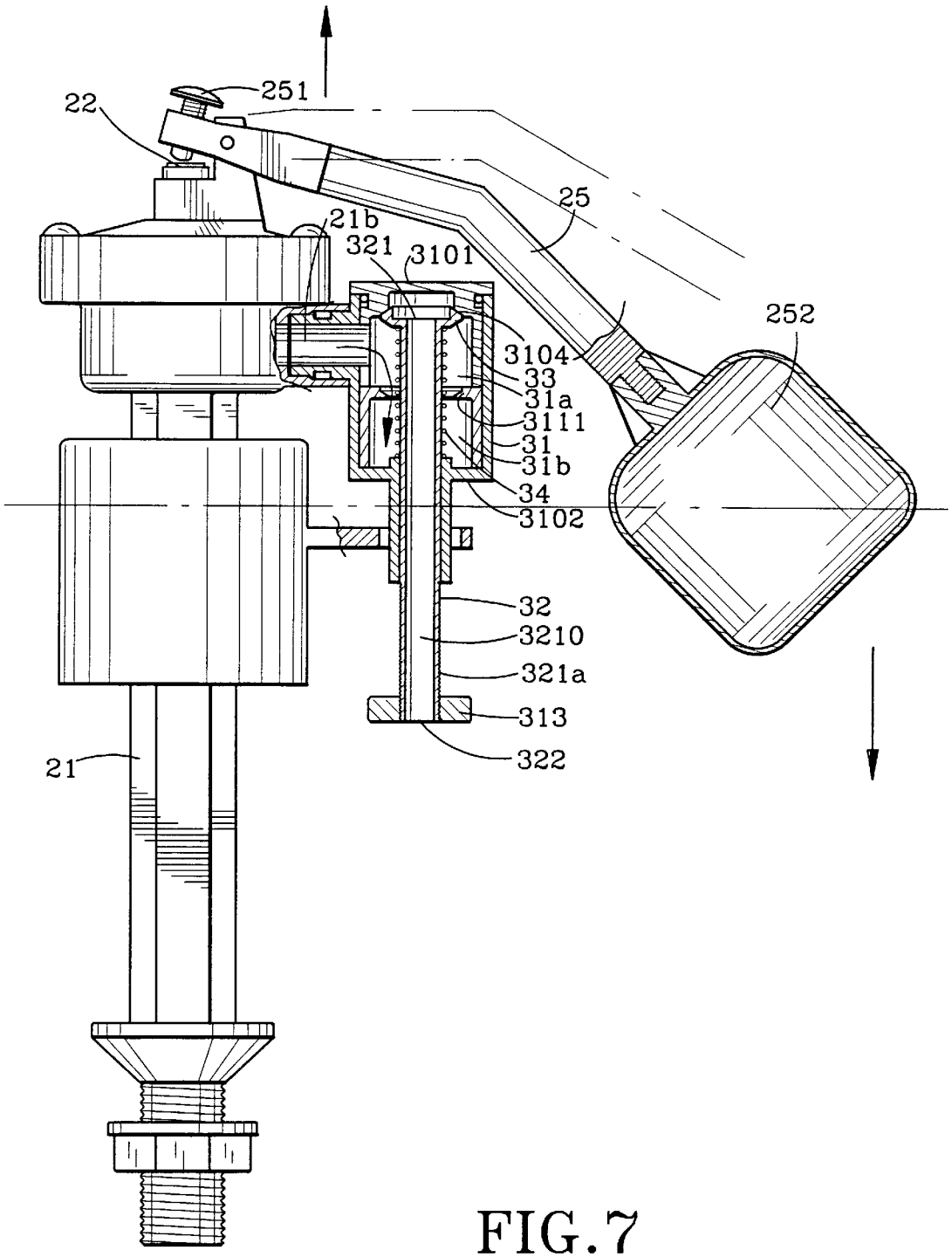
FIG. 7 a partly sectional view illustrating the float-controlled valve means in the water supply tank when actuated to permit water from the water supplying pipe to flow into the valve diverter means.

Referring to FIGS. 2 and 7, when the tank 50 is initially full, the float member 35 floats along the water line and does not exert any pulling force on the cable 58. The valve member 33 abuts against the second valve seat 3104 due to the upward spring force of the spring member 34. When the flush handle 51 is operated, the flapper valve 52 is lifted so as to allow water in the tank 50 to flow through the discharge outlet 56 and into the neck portion 55 of the toilet bowl 53. As the water level in the tank 50 drops, the main float 252 and the float member 35 are lowered, thereby opening the ball-cock valve 22. High pressure water from the water supplying pipe 21 enters the diverter valve means 30 and is directed to the supply line 40. High pressure water thus enters the rim flushing conduit 54, thereby effectively rinsing the inner wall of the toilet bowl 53.

Figure 8:
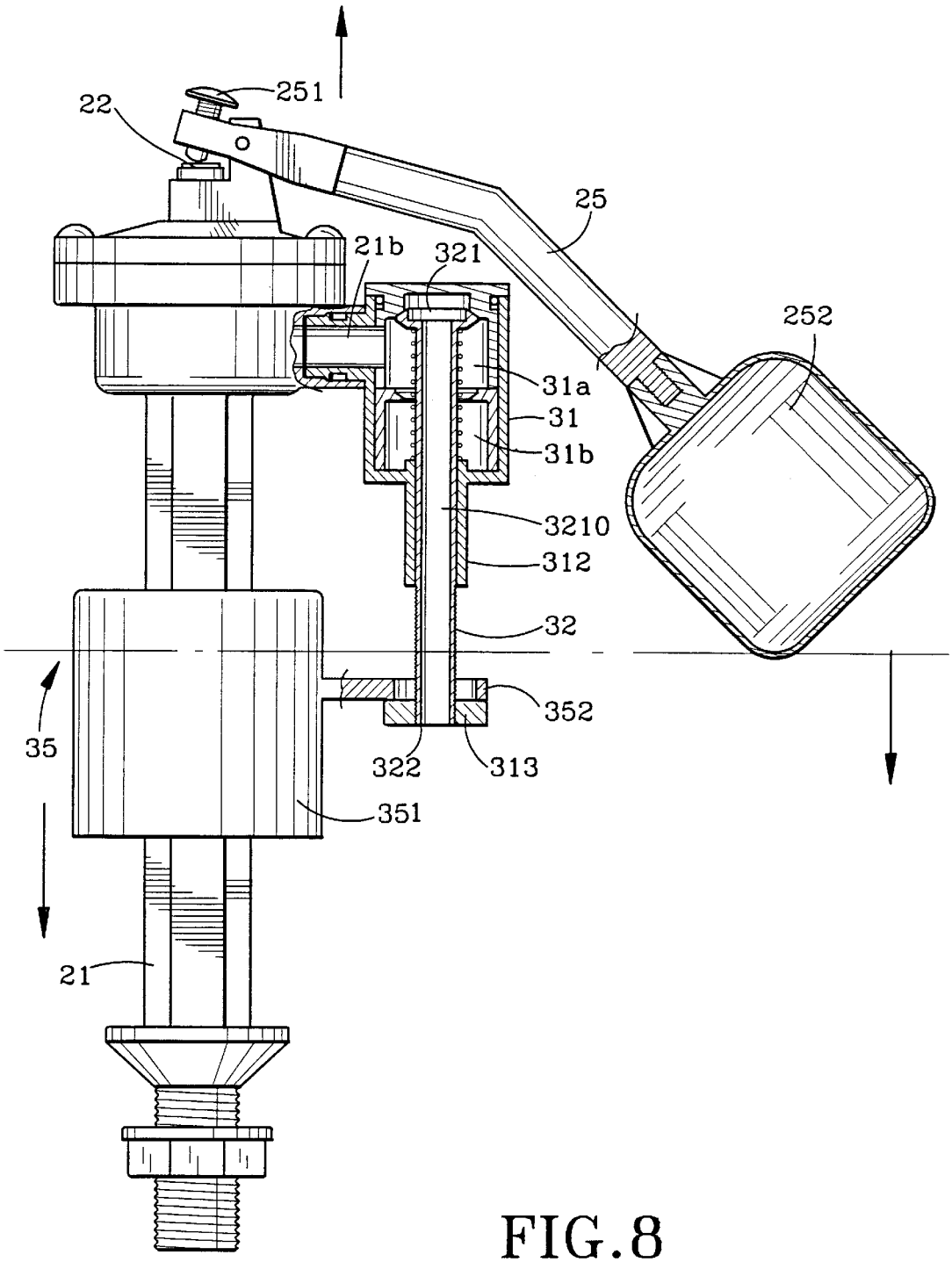
FIG. 8 is a partly sectional view illustrating the float member of the valve diverter means when it begins to pull the valve rod downward.
Figure 9:
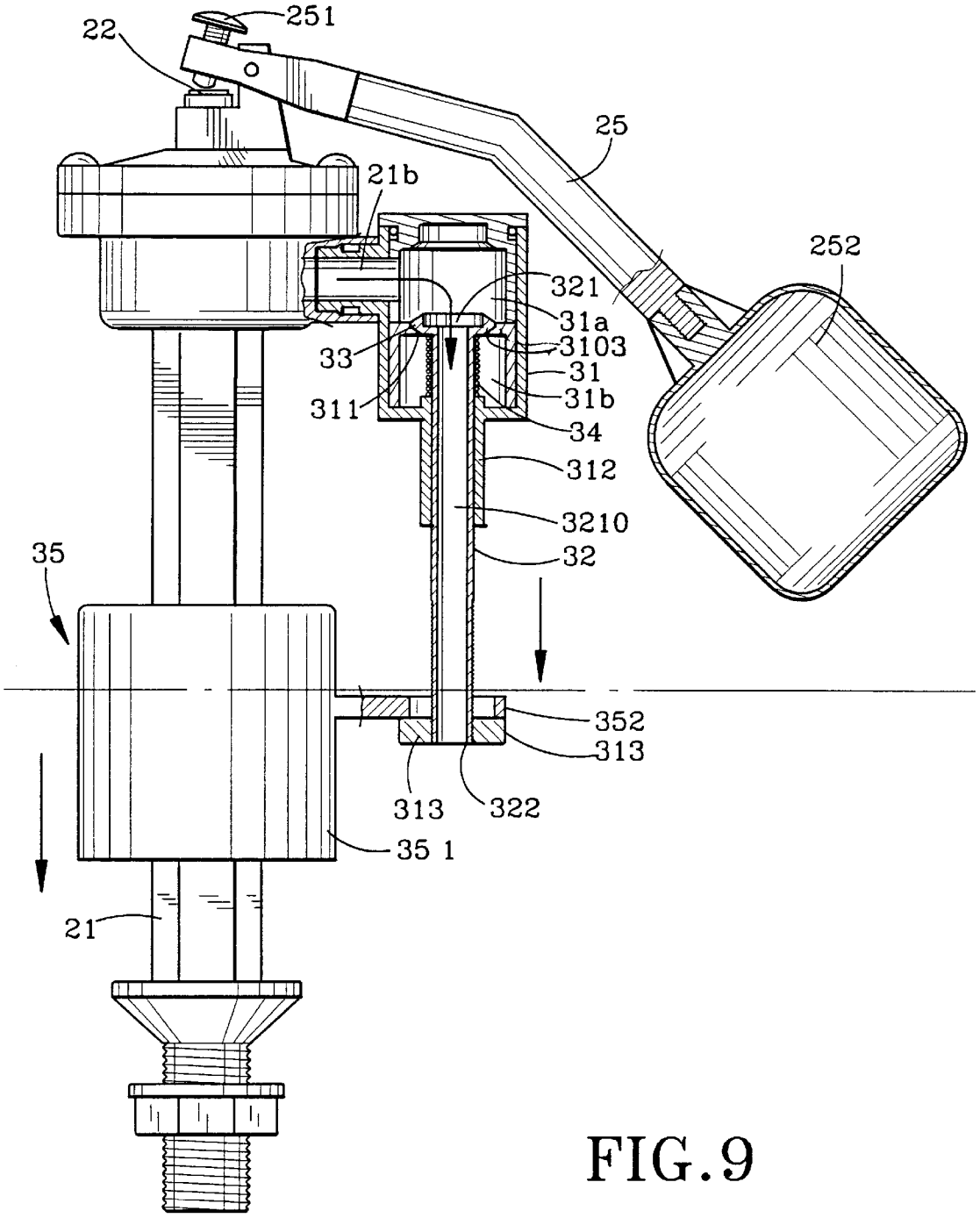
FIG. 9 is a partly sectional view illustrating the float member of the diverter valve means when moved to the lowermost position.

Referring to FIG. 8, as the water level in the tank 50 continues to gradually decrease, the extension plate 352 of the float member 35 moves downward and eventually engages the nut 313 and pulls the valve rod 32 to move downward against the spring force of the spring member 34 so as to permit the valve member 33 to seat on the first valve seat 3111, as best illustrated in FIG. 9. The water from the inlet pipe (21*b*) then flows into the passage 3210 of the valve rod 32 so as to refill the tank 50. Preferably, a clearance (not shown) is formed between the valve member 33 and the first valve seat 3111 when the valve member 33 is seated on the first valve seat 3111 so that a large portion of water from the inlet pipe (21*b*) flows into the tank 50 via the valve rod 32 while a small portion of water enters the supply line 40 via the clearance to refill the toilet bowl 53. The length of time during which the valve rod 32 is pulled by the float member 35 can be adjusted by rotating the nut 313 on the threaded portion (321*a*), thereby varying the distance between the extension plate 352 of the float member 35 and the nut 313. More water flows into the supply line 40 when the nut 313 is moved upward to a higher position with respect to the lower end 322 of the valve rod 32. Accordingly, less water flows through the supply line 40 when the nut 313 is moved to a lower position with respect to the lower end 322 of the valve rod 32.

Figure 10:
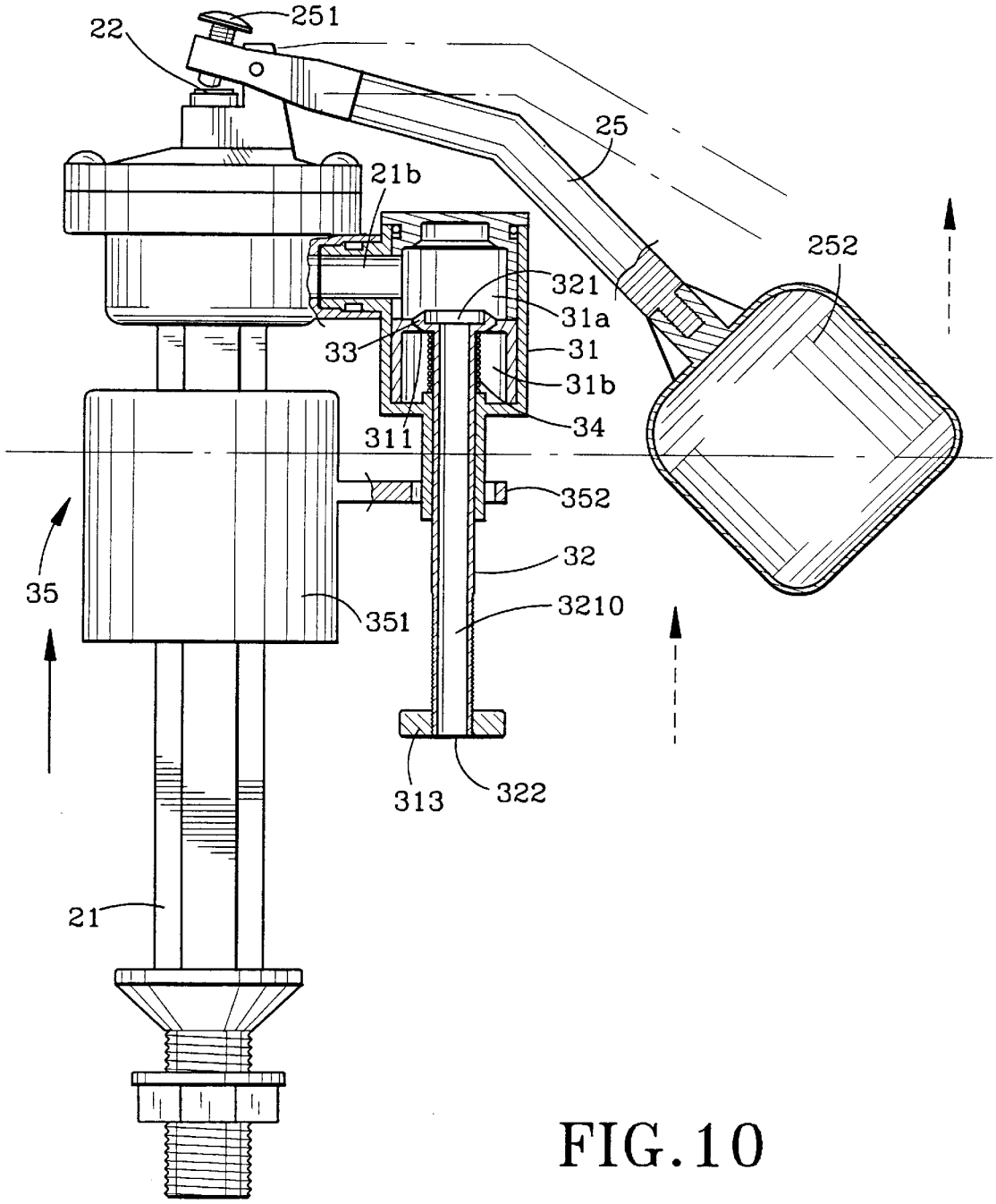
FIG. 10 is illustrates the float member of the diverter valve means when moved upward to disengage the valve rod.

Referring to FIG. 10, as the water level in the tank 50 rises, the main float 252 and the float member 35 gradually move upward. At this stage, the float member 35 disengages the nut 313, and the valve member 33 remains seated on the first valve seat 3111 due to the high water pressure exerted on the valve member 33. The valve rod 32 moves upward to permit the valve member 33 to abut against the second valve seat 3104 due to the restoring force of the spring member 34 when the main float 252 closes the cock-ball valve 22, thereby interrupting the water flowing from the water supplying pipe 21 into the diverter valve means 30.

Since the high pressure water flushes through the valve rod 32 as the water from the water supplying pipe 21 refills the tank 50, fouling formation on the upper end 321 and in the passage 3210 can be avoided.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A toilet flushing device to be installed in a toilet bowl assembly having a water supply tank and a toilet bowl with a rim-flushing conduit and a neck portion, said toilet flushing device including a water supplying pipe adapted to extend into said water supply tank and that has a lower end connected to an external pressurized water source; float-controlled valve means provided on an upper end of said water supplying pipe to control water to flow from said water supplying pipe to said water supply tank; manually operated flush valve means for discharging water inside said water supply tank to said neck portion of said toilet bowl; and diverter valve means for communicating fluidly said water supplying pipe and said water supply tank, said diverter valve means including a hollow valve housing, a transverse inlet pipe which receives water from said water supplying pipe, and a transverse supply line adapted to be connected to and supply water to said rim flushing conduit of said toilet bowl; the improvement comprising:

said valve housing having top and bottom walls, a transverse partition wall between said top and bottom walls, and upper and lower chambers divided by said partition wall, said partition wall having an opening and a first valve seat that confines said opening, said inlet pipe and said supply line being communicated respectively with said upper and lower chambers, said valve housing further having communication means for interconnecting said upper chamber and said water supply tank;

said diverter valve means further having a valve rod with upper and lower ends, said upper end of said valve rod extending into said upper chamber and being provided with a valve member, said lower end extending out of said valve housing, said valve rod passing through said opening of said partition wall without sealing said opening and sealingly extending through said bottom wall, said valve rod being normally biased upward so as to move said valve member away from said first valve seat, thereby permitting water from said inlet pipe to flow from said upper chamber to said lower chamber by passing through said opening around said valve rod and then to said supply line;

said diverter valve means further having a float member which is connected movably to said valve rod and which is movable downward, in response to a decrease in the water level inside said water supply tank when said flush valve means is operated, to pull down said valve rod, thereby moving said valve member downward to said first valve seat and interrupting communication between said upper and lower chambers and permitting water from said inlet pipe to flow through said communicating means to refill said water supply tank.

2. The toilet flushing device as claimed in claim 1, wherein said communicating means includes a passage extending longitudinally through said valve rod.

3. The toilet flushing device as claimed in claim 2, wherein said valve rod has a threaded portion provided adjacent to said lower end thereof, and a nut engaging said threaded portion of said valve rod to form an adjustable initial vertical distance between said float member and said nut.

4. The toilet flushing device as claimed in claim 3, wherein said float member has a float body sleeved on said water supplying pipe, and a transverse plate which extends from said float body, said valve rod extending slidably through said transverse plate.

5. The toilet flushing device as claimed in claim 4, wherein said top wall of said valve housing has a second valve seat formed therein, said valve rod having a spring member sleeved therearound between said valve member and said bottom wall, said spring member biasing normally said valve rod upward so as to seat said valve member against said second valve seat.

* * * * *